US009845099B2

(12) United States Patent
Kurz

(10) Patent No.: US 9,845,099 B2
(45) Date of Patent: Dec. 19, 2017

(54) DATA MANAGEMENT SYSTEM AND METHOD FOR A TARGET DEVICE OF A VEHICLE

(71) Applicant: Westinghouse Air Brake Technologies Corporation, Wilmerding, PA (US)

(72) Inventor: Brian E. Kurz, Germantown, MD (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 132 days.

(21) Appl. No.: 14/489,910

(22) Filed: Sep. 18, 2014

(65) Prior Publication Data

US 2016/0082988 A1 Mar. 24, 2016

(51) Int. Cl.
*B61L 15/00* (2006.01)

(52) U.S. Cl.
CPC ..... *B61L 15/0072* (2013.01); *B61L 15/0027* (2013.01); *B61L 15/0036* (2013.01); *B61L 15/0063* (2013.01)

(58) Field of Classification Search
None
See application file for complete search history.

(56) References Cited

U.S. PATENT DOCUMENTS 4,582,280 A * 4/1986 Nichols ..... B60L 15/32 105/61
5,065,321 A 11/1991 Bezos et al.
5,185,700 A 2/1993 Bezos et al.
7,263,475 B2 8/2007 Hawthorne et al.
7,769,509 B2 8/2010 Gaughan et al.
8,239,092 B2 8/2012 Plante et al.
8,935,022 B2 * 1/2015 Cooper ..... B61L 15/0036 180/14.1
9,227,639 B1 * 1/2016 Bryant ..... B61L 3/00
9,254,855 B2 * 2/2016 Kernwein ..... B61L 27/0011
2007/0219686 A1 9/2007 Plante
2009/0094367 A1 * 4/2009 Song ..... H04L 12/1818 709/227
2010/0063656 A1 * 3/2010 Knott ..... B61L 3/221 701/19
2010/0099447 A1 * 4/2010 Boberg ..... H04L 67/26 455/466
2010/0286853 A1 * 11/2010 Goodermuth ..... B61L 15/0072 701/19
2012/0123617 A1 * 5/2012 Noffsinger ..... B61L 15/0081 701/19
2014/0229040 A1 * 8/2014 Weber ..... B61L 23/00 701/19
2014/0372498 A1 * 12/2014 Mian ..... H04L 67/12 709/201
2014/0372516 A1 * 12/2014 Watte ..... H04L 51/14 709/203

* cited by examiner

*Primary Examiner* — Khoi Tran
*Assistant Examiner* — Donald J Wallace
(74) *Attorney, Agent, or Firm* — The Webb Law Firm

(57) ABSTRACT

System and computer-implemented methods and processes for data management of a plurality of target devices of a vehicle, the system including a portable computer device programmed for wireless connectivity to a network and data management activities and interaction with the target devices. The system and computer-implemented methods and processes are particularly useful in connection with trains having at least one locomotive, where the train includes multiple target devices, such as a train event recording system and the like.

37 Claims, 1 Drawing Sheet

DATA MANAGEMENT SYSTEM AND METHOD FOR A TARGET DEVICE OF A VEHICLE

BACKGROUND OF THE INVENTION

Field of the Invention

This invention relates generally to vehicle systems and networks, such as railway systems including trains travelling in a track or rail network, and in particular to data management systems and methods for use in connection with one or more target devices, such as train event recording systems and associated devices, used on or in connection with one or more locomotives or railcars of a train.

Description of Related Art

Vehicle systems and networks exist throughout the world; and, at any point in time, a multitude of vehicles, such as cars, trucks, buses, trains, and the like, are travelling throughout the system and network. Many of these vehicles are equipped with various target devices that measure, determine, and/or track certain conditions, parameters, operational states, physical data or information, and the like. For example, a train may include an event recorder and/or other components or devices that measure, determine, and/or track certain conditions or states of the equipment or components of the train, such as pressure, temperature, speed, operational states, and the like. These devices are normally attached to or associated with one or more of the locomotives of a train. Further, in another example, such event recorders and/or other components or devices are attached to or associated with a truck, a bus, or other vehicle where the conditions and states of certain pieces of equipment are or should be tracked.

With respect to railway systems, and as is known, train event recorders and recording systems receive and store train event data from a train management system and/or other components and systems of a locomotive, railcar, track network, wayside equipment, end-of-train unit, head-of-train device unit, and the like. Train event recording systems are designed to be crash-worthy and include crash-resistant housings to preserve the recorded train event data in the event of a crash, derailment, or other type of accident. The train event data may include sensitive information meant only for intended or otherwise authorized recipients. Train event recorders and recording systems may provide download or transfer options to facilitate the transfer of train event data to one or more external storage devices.

The Federal Railroad Administration (FRA) requires train event recording systems to comply with basic specifications, although the capabilities of these systems can be enhanced beyond these requirements. To be in compliance, all leading locomotives of trains in the United States that travel faster than 30 miles per hour on a United States rail network must have crash-worthy event recording systems that record certain safety-critical events needed for investigating an accident.

Train event recording systems may monitor a variety of analog and digital outputs from the train management computer, directly from certain target devices that output data and information, and/or from other equipment and sources. The recorded train event data can be used to view and analyze specific criteria of the train event data after it is downloaded by a computer. Various existing train event recording systems and train management systems are shown and described in U.S. Pat. No. 8,239,092 to Plante et al., U.S. Pat. No. 7,769,509 to Gaughan et al., U.S. Pat. No. 7,263,475 to Hawthorne et al., U.S. Pat. No. 5,185,700 to Bezos et al., and U.S. Pat. No. 5,065,321 to Bezos et al., and U.S. Publication No. 2007/0219686 to Plante.

SUMMARY OF THE INVENTION

Generally, provided are data management systems and methods for a target device of a vehicle that represent improvements over existing data management systems. Preferably, provided are data management systems and methods for a target device of a vehicle that are useful in connection with railway system and the trains travelling therein. Preferably, provided are data management systems and methods for a target device of a vehicle that facilitate the ability to manage data from multiple locomotives and/or trains travelling in a track or rail network. Preferably, provided are data management systems and methods for a target device of a vehicle that facilitate effective communication and data exchange between a portable computer device and at least one target device. Preferably, provided are data management systems and methods for a target device of a vehicle that assist in updating the software or firmware of specified target devices, components, computers, or equipments of the vehicle.

According to one preferred and non-limiting embodiment, provided is a system for data management of a plurality of target devices of at least one vehicle, including: at least one portable computer device configured for wireless connectivity to at least one network, the at least one portable computer device having at least one processor and at least one memory with program instructions thereon, that, when executed by the at least one processor, cause the processor to: (a) connect to the at least one network; (b) identify at least one of the plurality of target devices of the at least one vehicle; (c) at least one of: (i) directly or indirectly receive at least a portion of data input to or output from at least one target device of the plurality of target devices, and (ii) directly or indirectly transmit data to at least one target device of the plurality of target devices; and (d) display at least a portion of at least one of: (i) the data input to or output from the at least one target device and (ii) the transmitted data, on at least one interface on the at least one portable computer device.

In another preferred and non-limiting embodiment, provided is a data management method for a plurality of target devices of at least one vehicle, including: (a) connecting at least one portable computer device to at least one network; (b) identifying at least one of the plurality of target devices of the vehicle; (c) at least one of: (i) directly or indirectly receiving at least a portion of data input to or output from at least one target device of the plurality of target devices, and (ii) directly or indirectly transmitting data to at least one target device of the plurality of target devices; and (d) displaying at least a portion of at least one of: (i) the data input to or output from the at least one target device and (ii) the transmitted data, on at least one interface on the at least one portable computer device.

In a further preferred and non-limiting embodiment, provided is a system for data management of at least one target device of at least one vehicle, including: at least one portable computer device configured for wireless connectivity to at least one network, the at least one portable computer device having at least one processor and at least one memory with program instructions thereon, that, when executed by the at least one processor, cause the processor to: (a) connect to the at least one network; (b) transmit a session request to the at least one target device; (c) receive an acknowledgement from the at least one target device if the session request is accepted by the at least one target device; (d) at least one of: (i) directly or indirectly receive at least a portion of data input to or output from the at least one target device, and (ii) directly or indirectly transmit data to the at least one target device; and (e) display at least a portion of at least one of: (i) the data input to or output from the at least one target device and (ii) the transmitted data, on at least one interface on the at least one portable computer device.

In a still further preferred and non-limiting embodiment, provided is a data management method for at least one target device of at least one vehicle, including: (a) connecting at least one portable computer device to at least one network; (b) transmitting a session request to the at least one target device; (c) receiving an acknowledgement from the at least one target device if the session request is accepted by the at least one target device; (d) at least one of: (i) directly or indirectly receiving at least a portion of data input to or output from the at least one target device, and (ii) directly or indirectly transmitting data to the at least one target device; and (e) displaying at least a portion of at least one of: (i) the data input to or output from the at least one target device and (ii) the transmitted data, on at least one interface on the at least one portable computer device.

In another preferred and non-limiting embodiment, provided is a system for data management of at least one target device of at least one vehicle, including: at least one portable computer device configured for wireless connectivity to at least one network, the at least one portable computer device having at least one processor and at least one memory with program instructions thereon, that, when executed by the at least one processor, cause the processor to: (a) connect to the at least one network; (b) directly or indirectly receive revision data associated with software or firmware of the at least one target device; (c) transmit at least a portion of the revision data directly or indirectly to the at least one target device; and (d) cause at least a portion of the software or firmware to be modified based at least in part upon at least a portion of the revision data.

In a further preferred and non-limiting embodiment, provided is a data management method for at least one target device of at least one vehicle, including: (a) connecting at least one portable computer device to at least one network; (b) directly or indirectly receiving revision data associated with software or firmware of the at least one target device; (c) transmitting at least a portion of the revision data directly or indirectly to the at least one target device; and (d) causing at least a portion of the software or firmware to be modified based at least in part upon at least a portion of the revision data.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
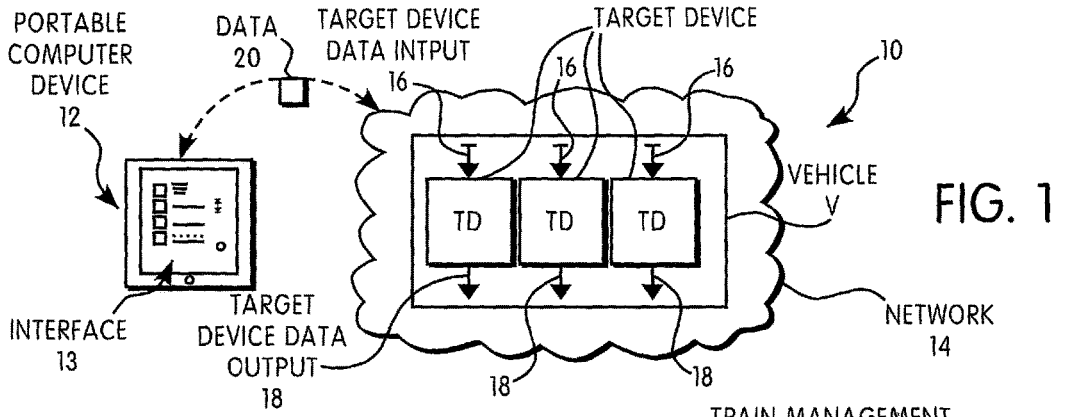
FIG. 1 is a schematic view of one embodiment of a data management system and method for a target device of a vehicle according to the principles of the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. It is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

As used herein, the terms "communication" and "communicate" refer to the receipt, transmission, or transfer of one or more signals, messages, commands, or other type of data. For one unit or device to be in communication with another unit or device means that the one unit or device is able to receive data from and/or transmit data to the other unit or device. A communication may use a direct or indirect connection, and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data, and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, and/or the like.

The terms "train event recorder" and "train event recording system," as used interchangeably herein, may refer to any event recording device or system used on a train that records train event data. A train event recording system may include one or more hardware and/or software components in communication with one or more components and/or systems of a train or railway such as, but not limited to, a train management computer, a head-of-train unit, an end-of-train unit, wayside equipment, operator interfaces and/or other like systems and components. A train event recording system is configured to record and store train event data representing information about locomotives, railcars, wayside equipment, track signals, and/or train operators including, but not limited to, velocity, brake pressure, error signals, system states, prompts and user inputs, mandatory directives, movement authority signals, warnings and enforcement information, direction of travel, distance traveled, throttle position, brake operation, headlight status, horn operation, cab signals, audio data, video data, and/or the like. In addition to train event recorders installed in a locomotive and in communication with a train management computer, event recorders may also include railcar event recorders, such as that described by U.S. Pat. No. 7,769,509 to Gaughan et al., the entirety of which is incorporated by reference herein.

Figure 2:
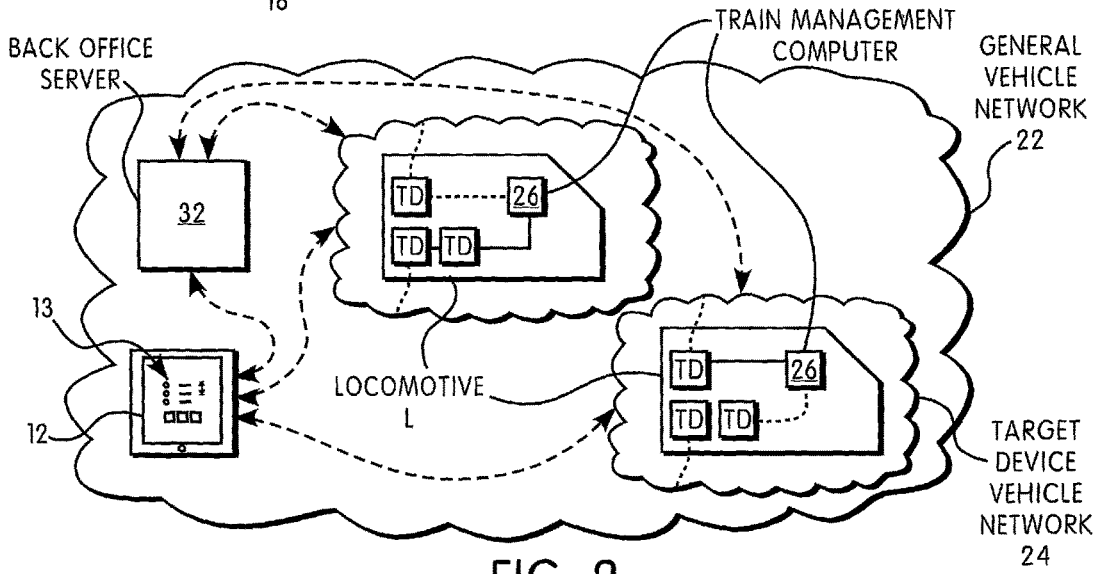
FIG. 2 is a schematic view of another embodiment of a data management system and method for a target device of a vehicle according to the principles of the present invention.
Figure 3:
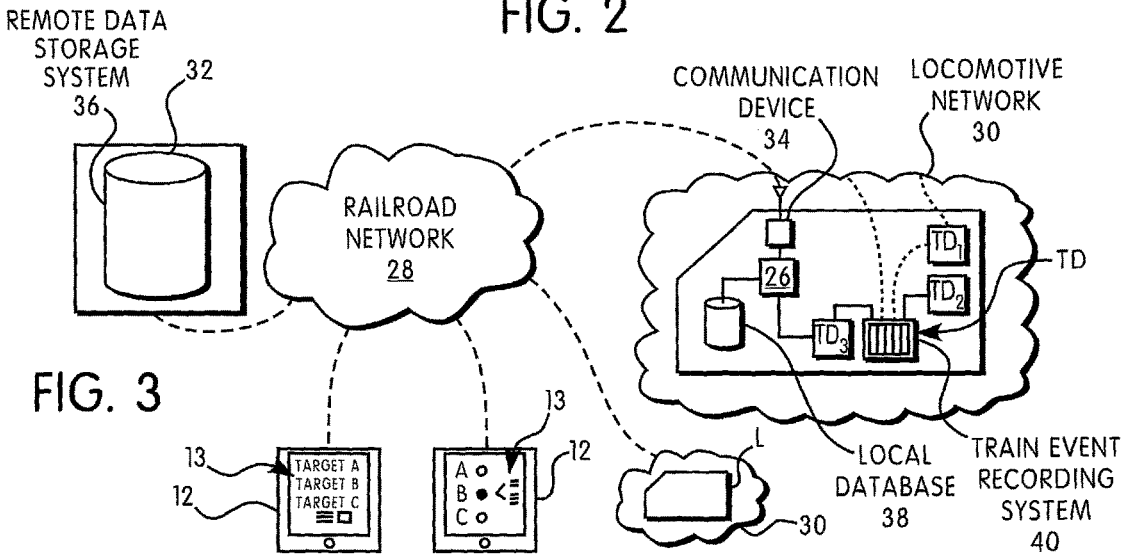
FIG. 3 is a schematic view of a further embodiment of a data management system and method for a target device of a vehicle according to the principles of the present invention.

The present invention is directed to a data management system 10 and method for a target device of a vehicle, as illustrated in certain preferred and non-limiting embodiments in FIGS. 1-3. While applicable to and useful in connection with a variety of vehicles, vehicle networks, and target devices, in one preferred and non-limiting embodiment, the systems and methods described herein are particularly useful in connection with trains travelling in a track network or system.

With reference to FIG. 1, and in one preferred and non-limiting embodiment, provided is a system 10 for data management of one or more target devices (TD) that are positioned on or associated with a vehicle (V). The system 10 includes at least one portable computer device 12 programmed or configured for wireless connectivity to or within at least one network 14, where the at least one portable computer device 12 includes at least one processor and at least one memory with program instructions thereon, that, when executed by the at least one processor, cause the processor to connect to the at least one network 14 and identify at least one target device 12 of the plurality of target devices 12 of the vehicle (V). Further, the at least one processor is programmed or configured to directly or indirectly receive at least a portion of data (e.g., target device data input 16) input to or data (e.g., target device data output 18) output from at least one target device (TD) of the plurality of target devices (TD) and/or directly or indirectly transmit data 20 to at least one target device (TD) of the plurality of target devices (TD). Still further, and in this preferred and non-limiting embodiment, the at least one processor of the portable computer device 12 is programmed or configured to display (or cause the display of) at least a portion of the data input to or output from the at least one target device (TD) and/or the transmitted data 20, on at least one interface 13 (e.g., a graphical user interface) on the at least one portable computer device 12. As discussed hereinafter, the target device data input 16 and/or the target device data output 18 may represent a variety of data points, streaming data, information or data associated with the target device (TD), information or data associated with the vehicle (V) or any component thereof, information or data associated with the operation of the vehicle (V), information or data associated with any condition or status of the target device (TD) and/or the vehicle (V), and/or the like. Accordingly, and by using the portable computer device 12, a user can access and/or communicate with one or more of the target devices (TD) positioned on or associated with the vehicle (V). In addition, it is noted that the portable computing device 12 may take a variety of forms, including, but not limited to a smartphone, a tablet computer, a handheld computer, a portable computer, a laptop computer, a computing device, a programmable computing device, and the like, which, when programmed or configured with the instructions (i.e., the code or application sufficient to implement the described steps), become a specially-programmed device or computer, with the program instructions executed by a processor of the device or computer.

In another preferred and non-limiting embodiment, and with reference to FIG. 2, the connection step includes connecting first to a general vehicle network 22 and second to a target device vehicle network 24, where the general vehicle network 22 represents a network that is established system-wide and includes multiple vehicles (V), e.g., trains, operating in at least a portion of a railway system. Further, the target device vehicle network 24 represents a network established and associated with the vehicle (V), itself, e.g., a locomotive (L) of the train, where the target devices (TD) are positioned on, associated with, or in communication with the locomotive (L)—specifically, and in one preferred and non-limiting embodiment, a train management computer 26 of the locomotive (L). Accordingly, and as illustrated in FIG. 3, the general vehicle network 22 may be in the form of a railroad network 28, and the target device vehicle network 24 may be in the form of a locomotive network 30, where one or more of the target devices (TD) are in direct or indirect, wireless or hard-wired communication with the train management computer 26, which may be referred to as a target device (TD) itself.

With continued reference to FIG. 2, and in another preferred and non-limiting embodiment, the system 10 includes at least one back office server 32 (e.g., a remote server, a central dispatch server, a central controller, a remote railroad server, a remote system, a central dispatch system, a central controller system, a remote railroad system, and/or the like) wirelessly connected to the general vehicle network 22 (e.g., the railroad network 28). In this embodiment, the at least one processor of the portable computer device 12 is further programmed or configured to directly or indirectly receive data from the at least one back office server 32, and/or directly or indirectly transmit data to the at least one back office server 32.

In another preferred and non-limiting embodiment, the target device vehicle network 24 (e.g., the locomotive network 30) is at least partially established by the train management computer 26 of the locomotive (L) using at least one communication device 34. Further, this connection to or within the general vehicle network 22 (e.g., the railroad network 28) and/or the connection to or within the target device vehicle network 24 (e.g., the locomotive network 30) is a secure connection, where the network is secured and/or the data transmitted over the network is encrypted or otherwise protected. Similarly, the connection between the portable computer device 12 and the general vehicle network 22 (e.g., the railroad network 28) and/or the target device vehicle network 24 (e.g., the locomotive network 30) may be a secure connection.

In another preferred and non-limiting embodiment, and as discussed above, the vehicle (V) may be in the form of a train having one or more locomotives (L) associated therewith. Similarly, the target devices (TD) may include, without limitation, an event recorder, a data management device, a digital device, an analog device, a sensor arrangement, a testing arrangement, a device outputting speed data, a device outputting pressure data, a device outputting temperature data, a device outputting condition data, a device outputting parameter data, a device outputting status data, or any combination thereof. Such devices and components are used aboard the train to collect, monitor, track, manage, control, and/or process and transmit data regarding all aspects of the train and its operation in the railway system.

In another preferred and non-limiting embodiment, and as illustrated in FIG. 3, after connection to the at least one network 14 (e.g., the general vehicle network 22, the target device vehicle network 24, the railroad network 28, the locomotive network 30, and/or the like), the at least one processor of the portable computer device 12 is further programmed or configured to communicate with and check (or parse) at least one remote data storage system 36 for update data associated with at least one of the following: the at least one processor of the portable computer device 12, at least one application (e.g., a local application) executing on the processor of the portable computer device 12, at least one application configured to generate the interface 13, at least one application configured to generate data for the interface 13, train data (e.g., information or data associated with the train), locomotive data (e.g., information or data associated with the locomotive (L) or any component thereof, such as the train management computer 26), target device data (e.g., information or data associated with any target device (TD) or component thereof), configuration data (e.g., information or data directed to any configuration, setting, and/or operation of any component of the vehicle (V), portable computer device 12, network 14, train, locomotive (L), train management computer 26, back office server 32, remote data storage system 36, general vehicle network 22, target device vehicle network 24, railroad network 28, locomotive network 30, or any combination thereof), data format data (e.g., information or data directed to the form or format of the data or data structures associated with any component of the vehicle (V), portable computer device 12, network 14, train, locomotive (L), train management computer 26, back office server 32, remote data storage system 36, general vehicle network 22, target device vehicle network 24, railroad network 28, locomotive network 30, or any combination thereof), customer data (e.g., information or data associated with the customer, user, and/or operator of the vehicle (V), train, and/or the like), revision data (e.g., information or data directed to any revision or version, such as the current revision or version of the firmware or software, associated or used in connection with any component of the vehicle (V), portable computer device 12, network 14, train, locomotive (L), train management computer 26, back office server 32, remote data storage system 36, general vehicle network 22, target device vehicle network 24, railroad network 28, locomotive network 30, or any combination thereof), train management computer data (e.g., information or data specifically associated with or directed to the train management computer 26 and/or its components or data, such as an on-board train database), positive train control system data (e.g., information or data associated with operation of the train within a positive train control network or system), on-board controller data (e.g., information or data specifically associated with an on-board controller, such as the train management computer 26 and/or its components or data), authorization data (e.g., information or data that provides authorization levels for data access, output, processing, manipulation, creation, and/or transmission, whether unique (individual) authorization, group authorization, level authorization, modifiable or configurable authorization, and/or the like), train device data (e.g., information or data that is specifically associated with any device used on or in connection with the operation of the train, such as devices that provide target device data input 16 to a train event recording system or event recorder), or any combination thereof.

In another preferred and non-limiting embodiment, the at least one processor of the portable computer device 12 is further programmed or configured to: directly or indirectly receive configuration data (as discussed above) associated with the at least one target device (TD); directly or indirectly receive data format data (as discussed above) associated with the at least one target device (TD); and generate data for display on the interface 13 of the at least one portable computer device 12 at least partially based upon at least a portion of the configuration data and at least a portion of the data format data. In particular, a user can interact with and view information or data on the interface 13 (e.g., the GUI of the portable computer device 12), where the at least one processor of the portable computer device 12 uses the configuration data and data format data to "translate" the data of the target device (TD) into a usable and understandable data stream. One or more converters or translation routines or computer applications or programs can be used by the portable computer device 12 to display the information or data to the user of the interface 13. Further, and as discussed hereinafter, multiple target devices (TD) in the form of train devices, e.g., sensors and the like, may be providing input data 16 to a single target device (TD) in the form of a train event recording system or event recorder. As such, the system 10 facilitates the translation of these raw inputs, processed inputs, or data outputs 18 into a form and format most useful to the user of the portable computer device 12.

For example, the data format data may be railroad specific, railway system specific, customer specific, device specific, manufacturer specific, installer specific, model specific, and/or the like. In addition, the configuration data and/or the data format data may be directly or indirectly received from the remote data storage system 36 and/or some other remote server or system, such as from a database associated with the back office server 32. In this manner, the at least one processor of the portable computer device 12 can "understand" the data of the target device (TD), and process and/or display the information and data to the user in a legible and useful form and format.

In another preferred and non-limiting embodiment, the at least one processor of the portable computer device 12 is further programmed or configured to: directly or indirectly receive revision data (as discussed above) associated with software or firmware of the at least one target device (TD); transmit at least a portion of the revision data directly or indirectly to the at least one target device (TD); and cause at least a portion of the software or firmware to be modified based at least in part upon at least a portion of the revision data. Accordingly, and using the portable computer device 12, the firmware or software used on or associated with the target device (TD) can be revised, modified, and/or updated to the most recent version.

In a further preferred and non-limiting embodiment, the data input to (e.g., the target device data input 16) or output from (e.g., target device data output 18) the at least one target device (TD) and/or the transmitted data 20 includes at least one of the following: update data, train data, locomotive data, target device data, configuration data, data format data, customer data, revision data, train management computer data, positive train control system data, central controller data, authorization data, train device data, or any combination thereof. Further, at least a portion of the data 16 input to or data 18 output from the at least one target device (TD) is directly or indirectly received by the portable computer device 12 substantially in real time or dynamically (e.g., the data is streamed between the devices, whether in raw, processed, or formatted form).

In another preferred and non-limiting embodiment, the at least one processor of the portable computer device 12 is further programmed or configured to: directly or indirectly receive revision data associated with at least one local database 38 of the at least one locomotive (L), such as by or through the back office server 32 and over or within the general vehicle network 22, the target device vehicle network 24, the railroad network 28, and/or the locomotive network 30. At least a portion of the revision data is directly or indirectly transmitted to the at least one locomotive (L), such as the train management computer 26, and at least a portion of the at least one local database 38 is updated or modified based at least in part upon at least a portion of the revision data. Accordingly, the system 10 can facilitate updates of the systems and databases local to the locomotive (L), such as the track database, to the most recent version.

In a further preferred and non-limiting embodiment, the at least one processor of the portable computer device 12 is further programmed or configured to receive a list of at least a portion of the plurality of target devices (TD); receive a selection (e.g., over or through the interface 13) of at least one target device (TD) from the list of the plurality of target devices (TD); and establish a direct or indirect connection with the selected target device (TD) over the at least one network 14 (e.g., the railroad network 28 and/or the locomotive network 30). In addition, this listing of target devices (TD) may be generated at least partially based upon authorization data, where the at least one processor of the portable computer device 12 is further programmed or configured to transmit and/or receive authorization data. Therefore, the list of target devices (TD) may be presented or populated with only those target devices (TD) to which the user is authorized to interact. Alternatively, the list may include all target devices (TD) within range, but provide an indication of with which target device (TD) the user is authorized to interact. Of course, the authorization may be level-based, e.g., the user can receive and view information and data from a specified target device (TD) and/or locomotive (L), the user can transmit information and data to a specified target device (TD) and/or locomotive (L), the user can interact with and/or manipulate or modify data on a specified target device (TD) and/or locomotive (L), and/or the like.

As discussed above, and in another preferred and non-limiting embodiment, the target device (TD) is in the form of a train event recording system 40 on a locomotive (L). The train event recording system 40 includes multiple data channels programmed or configured to receive data from multiple train devices ($TD_x$) (e.g., other target devices (TD)), e.g., sensors, systems, monitors, computers, and/or the like. Each train device ($TD_x$) (e.g., $TD_1$, $TD_2$, and $TD_3$ in FIG. 3) is assigned to at least one data channel, and at least a portion of the data from the data channels is transmitted or streamed to the portable computer device 12 over the at least one network 14 (e.g., the railroad network 28 and/or the locomotive network 30). In addition, and in this embodiment, the at least one processor of the portable computer device 12 is further programmed or configured to: receive a list of the data channels or train device ($TD_x$) assigned to the data channel; receive a selection of at least one of the data channels or train device ($TD_x$) assigned to the data channel; and display at least a portion of the streamed data associated with the data channel or train device ($TD_x$) assigned to the at least one data channel. It is envisioned that the above-discussed authorization schema and levels may be used in connection with this listing and data interaction function relating to discrete data channels.

In another preferred and non-limiting embodiment, the at least one processor of the portable computer device 12 is further programmed or configured to: broadcast, over the at least one network 14 (e.g., the railroad network 28 and/or the locomotive network 30), a message or query for potential receipt by at least one target device (TD) of the plurality of target devices (TD); and receive, from at least one target device (TD), a responsive message. The responsive message may include at least one of the following: identification data (e.g., information or data directed to the specific target device (TD), e.g., type, manufacturer, model, customer, etc.), configuration data (e.g., information or data directed to the configuration or operation of the specific target device (TD)), part number data (e.g., information or data directed to the part number associated with the specific target device (TD)), serial number data (e.g., information or data directed to the serial number associated with the specific target device (TD)), or any combination thereof.

With continued reference to this preferred and non-limiting embodiment, the at least one processor of the portable computer device 12 is further programmed or configured to: receive a selection of the at least one target device (TD) from which a responsive message has been received; and transmit a session request to the selected target device (TD), again, potentially based upon authorization requirements. In this embodiment, the at least one processor of the portable computer device 12 is further programmed or configured to receive an acknowledgement from the selected target device (TD) if the session request is accepted by the selected target device (TD). The at least one processor of the portable computer device 12 is further programmed or configured to receive a device information message from the selected target device (TD), where the device information message includes configuration data (as discussed above) associated with the selected target device (TD).

In another preferred and non-limiting embodiment, the at least one processor of the portable computer device 12 is further programmed or configured to: transmit a subscription message (e.g., a request to interact or receive data) to the selected target device (TD); and if accepted or authenticated by the target device (TD) and/or the locomotive (L), receive streamed data that is input to (e.g., target device data input 16) or output from (e.g., target device data output 18) the selected target device (TD) based at least partially on the subscription message. In addition, the at least one processor of the portable computer device 12 is further programmed or configured to process at least a portion of the streamed data for display on the interface 13 (e.g., GUI of the portable computer device 12) at least partially based on at least, one of the following: customer data, format data, configuration data, or any combination thereof. Still further, the at least one processor of the portable computer device is further programmed or configured to transmit a cancellation message to the selected target device (TD) upon completion of at least one operation, thereby terminating the session between the portable computer device 12 and the target device (TD).

In another preferred and non-limiting embodiment, provided is a data management method for a plurality of target devices (TD) of at least one vehicle (V), including: (a) connecting at least one portable computer device 12 to at least one network 14; (b) identifying at least one of the plurality of target devices (TD) of the vehicle (V); (c) at least one of: (i) directly or indirectly receiving at least a portion of data 16 input to or data 18 output from at least one target device (TD) of the plurality of target devices (TD), and (ii) directly or indirectly transmitting data 20 to at least one target device (TD) of the plurality of target devices (TD); and (d) displaying at least a portion of at least one of: (i) the data 16 input to or data 18 output from the at least one target device (TD) and (ii) the transmitted data 20, on at least one interface 13 on the at least one portable computer device 12.

In a further preferred and non-limiting embodiment, provided is a system for data management of at least one target device (TD) of at least one vehicle (V), including: at least one portable computer device 12 programmed or configured for wireless connectivity to at least one network 14, the at least one portable computer device 12 having at least one processor and at least one memory with program instructions thereon, that, when executed by the at least one processor, cause the processor to: (a) connect to the at least one network 14; (b) transmit a session request to the at least one target device (TD); (c) receive an acknowledgement from the at least one target device (TD) if the session request is accepted by the at least one target device (TD); (d) at least one of (i) directly or indirectly receive at least a portion of data 16 input to or data 18 output from the at least one target device (TD), and (ii) directly or indirectly transmit data 20 to the at least one target device (TD); and (e) display at least a portion of at least one of: (i) the data 16 input to or data 18 output from the at least one target device (TD) and (ii) the transmitted data 20, on at least one interface 13 on the at least one portable computer device 12.

In another preferred and non-limiting embodiment, provided is a data management method for at least one target device (TD) of at least one vehicle (V), including: (a) connecting at least one portable computer device 12 to at least one network 14; (b) transmitting a session request to the at least one target device (TD); (c) receiving an acknowledgement from the at least one target device (TD) if the session request is accepted by the at least one target device (TD); (d) at least one of: (i) directly or indirectly receiving at least a portion of data 16 input to or data 18 output from the at least one target device (TD), and (ii) directly or indirectly transmitting data 20 to the at least one target device (TD); and (e) displaying at least a portion of at least one of: (i) the data 16 input to or data 18 output from the at least one target device (TD) and (ii) the transmitted data 20, on at least one interface 13 on the at least one portable computer device 12.

In a further preferred and non-limiting embodiment, provided is a system for data management of at least one target device (TD) of at least one vehicle (V), including: at least one portable computer device 12 programmed or configured for wireless connectivity to at least one network 14, the at least one portable computer device 12 having at least one processor and at least one memory with program instructions thereon, that, when executed by the at least one processor, cause the processor to: (a) connect to the at least one network 14; (b) directly or indirectly receive revision data associated with software or firmware of the at least one target device (TD); (c) transmit at least a portion of the revision data directly or indirectly to the at least one target device (TD); and (d) cause at least a portion of the software or firmware to be modified based at least in part upon at least a portion of the revision data.

In a still further preferred and non-limiting embodiment, provided is a data management method for at least one target device (TD) of at least one vehicle (V), including: (a) connecting at least one portable computer device 12 to at least one network; (b) directly or indirectly receiving revision data associated with software or firmware of the at least one target device (TD); (c) transmitting at least a portion of the revision data directly or indirectly to the at least one target device (TD); and (d) causing at least a portion of the software or firmware to be modified based at least in part upon at least a portion of the revision data.

In this manner, embodiment of the systems 10 and methods facilitate access to and interaction with target devices (TD), e.g., target devices (TD) on a train, using a portable computer device 12, such as a smartphone, tablet computer, handheld computer, laptop, and/or the like, loaded with the application or executable instructions to implement the above-described processes. The appropriate applications or program instructions can be loaded (whether by firmware or software) on the portable computer device 12 that facilitates this interaction with the locomotive (L), train management computer 26, and/or target devices (TD). Regardless of application or target device (TD), the system 10 and method will allow the users to establish secure connections, such as connections with or between the back office server 32 and the locomotive network 30 (and devices and computers operating within the locomotive network 30 and/or railroad network 28). As discussed, and upon connection to or within the system 10, the executable application or processes executed on the portable computer device 12 facilitates the direct or indirect transfer of data between the back office server 32, the portable computer device 12, and/or the target devices (TD) onboard the locomotive (L) or train.

In one exemplary embodiment, the systems 10 and methods described herein facilitate or provide for: the creation of a secure connection between the back office server 32 and the portable computer device 12 (and/or the application executed on the portable computer device 12); creation of a secure connection between the portable computer device 12 (and/or the application executed on the portable computer device 12) and the target device (TD); bi-directional data transfer or communication between the portable computer device 12 (and/or the application executed on the portable computer device 12) and the back office server 32; and/or bi-directional data transfer or communication between the portable computer device 12 (and/or the application executed on the portable computer device 12) and the target device (TD).

The presently-invented systems 10 and methods have a variety of applications, as discussed above, including, but not limited to, use as a wireless verifier for event recorders, uploading of event recorder firmware, downloading of information and data from the event recorder, providing a "health check" for the event recorder, providing a "health check" for the PTC system, and/or verifying and/or updating the track database on a locomotive (L). With respect to the verification process in this exemplary embodiment, the user will open the application on the portable computer device 12, such as the user's smartphone, and the application will connect to a remote data storage system 36, e.g., a private railroad application store (such as the remote data storage system 36), and check for updates. If an update is available, the user will be prompted to update the application. The application will then connect to the locomotive network 30 and query the target device (TD), e.g., in this case, an event recorder, for the current configuration. The application will then retrieve the appropriate data format from the private railroad application store. Next, the application will initiate the verifier stream from the event recorder and decode and/or display the information and data per the downloaded data format. In another exemplary embodiment, the user is capable of retrieving the latest version of software or firmware for the selected target device (TD), e.g., an event recorder, and then initiate software or firmware upload on the target device (TD), without requiring physical connection to the event recorder. In another exemplary embodiment, the user is able to retrieve a data file to their portable computer device 12 via a wireless connection. In addition, and in another exemplary embodiment, the user is capable of viewing the current health status of the target device (TD), e.g., an event recorder, on their portable computer device 12 via a wireless connection. In another exemplary embodiment, the method or process includes the user initiating the application on the portable computer device 12, the device connecting to the private railroad application store over a secure connection, the application checking for updated application software (and, if available, updating the software), the application establishing a secure connection to the locomotive network 30, and the application communicating with the target device (TD) to perform available interactions.

In another exemplary embodiment, the systems 10 and methods discussed herein facilitate a beneficial combination of event recorder with a wireless interface and an application executed on a handheld device over a built-in wireless interface. In this exemplary embodiment, the application allows the user to monitor the data being sent to the event recorder to verify installation and operation of the event recorder in real-time without performing an event recorder data download. In this embodiment, the system 10 permits or facilitates the streaming of real-time data channels from the event recorder hardware to the handheld device over WI-FI, and display the information to the user in a GUI. The application can identify a current event recorder configurations for any event recorders within range of the handheld device, and monitor the current recorder "health" wirelessly.

In another exemplary embodiment, a method or process is as follows: a user installs the appropriate application on the portable computer device 12; the user executes the application on the device 12; the application broadcasts a message to any target device (TD) with the wireless verifier capability; each target device (TD) with the capability responds with information, such as part number and serial number; the user selects the desired target device (TD) to monitor, and the application sends a session request to the target device (TD); the target device (TD) accepts the session request and sends an acknowledgment; the target device (TD) sends a device information request containing current device configuration information; the user selects verifier operation, and the application sends a verifier stream subscription message to the target device (TD) and/or the event recorder; the event recorder streams the recorder data channels to the application; the application interprets the data based upon customer format and displays the information to the user on the display; upon completion, the user stops the wireless verifier operation and the application transmits a verifier stream cancellation message; and the event recorder closes the verifier stream.

In this manner, the present invention provides an improved data management system and method for a target device of a vehicle.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A system for data management of a plurality of target devices of at least one vehicle, comprising:

at least one portable computer device configured for wireless connectivity to at least one network, the at least one portable computer device comprising at least one processor and at least one memory with program instructions thereon, that, when executed by the at least one processor, cause the processor to:

(a) connect to the at least one network;

(b) identify at least one of the plurality of target devices of the at least one vehicle;

(c) at least one of: (i) directly or indirectly receive at least a portion of data input to or output from at least one target device of the plurality of target devices, and (ii) directly or indirectly transmit data to at least one target device of the plurality of target devices;

(d) display at least a portion of at least one of: (i) the data input to or output from the at least one target device and (ii) the transmitted data, on at least one interface on the at least one portable computer device;

directly or indirectly receive revision data associated with software or firmware of the at least one target device from at least one of a general vehicle network and a back office server;

transmit at least a portion of the revision data directly or indirectly to the at least one target device; and cause at least a portion of the software or firmware to be modified based at least in part upon at least a portion of the revision data, wherein the processor connects to the at least one network by connecting first to a general vehicle network and second to a target device vehicle network.

2. The system of claim 1, wherein the general vehicle network is a railroad network and the target device vehicle network is a locomotive network.

3. The system of claim 2, wherein the locomotive network is at least partially established by a train management computer on the locomotive.

4. The system of claim 1, wherein at least one of the connection to the general vehicle network and the connection to the target device vehicle network is a secure connection.

5. The system of claim 1, wherein the at least one vehicle is a train having at least one locomotive, and the at least one target device is at least one of the following: an event recorder, a data management device, a digital device, an analog device, a sensor arrangement, a testing arrangement, a device outputting speed data, a device outputting pressure data, a device outputting temperature data, a device outputting condition data, a device outputting parameter data, a device outputting status data, or any combination thereof.

6. The system of claim 1, wherein the connection between the at least one portable computer device and the at least one network comprises a secure connection.

7. The system of claim 1, wherein, after connection to the at least one network, the at least one processor is further programmed to check at least one remote data storage system for update data associated with at least one of the following: the at least one processor, at least one application executing on the processor, at least one application configured to generate the interface, at least one application configured to generate data for the interface, train data, locomotive data, target device data, configuration data, data format data, customer data, revision data, train management computer data, positive train control system data, on-board controller data, authorization data, train device data, or any combination thereof.

8. The system of claim 1, wherein the at least one processor is further programmed to:

directly or indirectly receive configuration data associated with the at least one target device;

directly or indirectly receive data format data associated with the at least one target device; and generate data for display on the interface of the at least one portable computer device at least partially based upon at least a portion of the configuration data and at least a portion of the data format data.

9. The system of claim 8, wherein the data format data comprises customer data.

10. The system of claim 8, wherein at least a portion of at least one of the data format data and the configuration data is directly or indirectly received from a remote data storage system.

11. The system of claim 1, wherein at least one of: (i) the data input to or output from the at least one target device, and (ii) the transmitted data comprises at least one of the following: update data, train data, locomotive data, target device data, configuration data, data format data, customer data, revision data, train management computer data, positive train control system data, central controller data, authorization data, train device data, or any combination thereof.

12. The system of claim 1, wherein the at least a portion of the data input to or output from the at least one target device is directly or indirectly received substantially in real time.

13. The system of claim 1, wherein the at least one vehicle is at least one train having at least one locomotive, and wherein the at least one processor is further programmed to:

directly or indirectly receive revision data associated with at least one local database of the at least one locomotive;

transmit at least a portion of the revision data directly or indirectly to the at least one locomotive; and cause at least a portion of the at least one local database to be modified based at least in part upon at least a portion of the revision data.

14. The system of claim 1, wherein the at least one processor is further programmed to:

receive a list of at least a portion of the plurality of target devices;

receive a selection of at least one target device from the list of target devices; and establish a direct or indirect connection with the selected target device over the at least one network.

15. The system of claim 14, wherein the list of the portion of the plurality of target devices is generated at least partially based upon authorization data.

16. The system of claim 1, wherein the at least one processor is further programmed to at least one of transmit and receive authorization data.

17. The system of claim 1, wherein the at least one target device comprises at least one train event recording system on a locomotive, the train event recording system comprising a plurality of data channels configured to receive data from a plurality of train devices, each train device assigned to at least one data channel.

18. The system of claim 17, wherein at least a portion of the data from at least one of the plurality of data channels is streamed to the at least one portable computer device over the at least one network.

19. The system of claim 18, wherein the at least one processor is further programmed to:

receive a list of the plurality of data channels or train device assigned to the at least one data channel;

receive a selection of at least one of the plurality of data channels or train device assigned to the at least one data channel; and display at least a portion of the streamed data associated with the at least one of the plurality of data channels or train device assigned to the at least one data channel.

20. The system of claim 1, wherein the at least one processor is further programmed to:

broadcast, over the at least one network, a message for potential receipt by at least one target device of the plurality of target devices; and receive, from at least one target device of the plurality of target devices, a responsive message.

21. The system of claim 20, wherein the responsive message comprises at least one of the following: identification data, configuration data, part number data, serial number data, or any combination thereof.

22. The system of claim 20, wherein the at least one processor is further programmed to:

receive a selection of the at least one target device from which a responsive message has been received; and transmit a session request to the selected target device.

23. The system of claim 22, wherein the at least one processor is further programmed to receive an acknowledgement from the selected target device if the session request is accepted by the selected target device.

24. The system of claim 22, wherein the at least one processor is further programmed to receive a device information message from the selected target device, wherein the device information message comprises configuration data associated with the selected target device.

25. The system of claim 22, wherein the at least one processor is further programmed to transmit a subscription message to the selected target device.

26. The system of claim 25, wherein the at least one processor is further programmed to receive streamed data that is input to or output from the selected target device based at least partially on the subscription message.

27. The system of claim 26, wherein the at least one processor is further programmed to process at least a portion of the streamed data for display on the at least one portable computer device at least partially based on at least one of the following: customer data, format data, configuration data, or any combination thereof.

28. The system of claim 22, wherein the at least one processor is further programmed to transmit a cancellation message to the selected target device upon completion of at least one operation.

29. A data management method for a plurality of target devices of at least one vehicle, comprising:

(a) connecting at least one portable computer device to at least one network;

(b) identifying at least one of the plurality of target devices of the vehicle;

(c) at least one of: (i) directly or indirectly receiving at least a portion of data input to or output from at least one target device of the plurality of target devices, and (ii) directly or indirectly transmitting data to at least one target device of the plurality of target devices;

(d) displaying at least a portion of at least one of: (i) the data input to or output from the at least one target device and (ii) the transmitted data, on at least one interface on the at least one portable computer device;

(e) directly or indirectly receiving revision data associated with software or firmware of the at least one target device from at least one of a general vehicle network and a back office server;

(f) transmitting at least a portion of the revision data directly or indirectly to the at least one target device; and (g) causing at least a portion of the software or firmware to be modified based at least in part upon at least a portion of the revision data, wherein connecting to the at least one portable computer device to the at least one network comprises connecting first to a general vehicle network and second to a target device vehicle network.

30. A system for data management of at least one target device of at least one vehicle, comprising:

at least one portable computer device configured for wireless connectivity to at least one network, the at least one portable computer device comprising at least one processor and at least one memory with program instructions thereon, that, when executed by the at least one processor, cause the processor to:

(a) connect to the at least one network;

(b) transmit a session request to the at least one target device;

(c) receive an acknowledgement from the at least one target device if the session request is accepted by the at least one target device;

(d) at least one of: (i) directly or indirectly receive at least a portion of data input to or output from the at least one target device, and (ii) directly or indirectly transmit data to the at least one target device;

(e) display at least a portion of at least one of: (i) the data input to or output from the at least one target device and (ii) the transmitted data, on at least one interface on the at least one portable computer device;

(f) directly or indirectly receive revision data associated with software or firmware of the at least one target device from at least one of the network and a back office server;

(g) transmit at least a portion of the revision data directly or indirectly to the at least one target device; and (h) cause at least a portion of the software or firmware to be modified based at least in part upon at least a portion of the revision data, wherein the processor connects to the at least one network by connecting first to a general vehicle network and second to a target device vehicle network.

31. A data management method for at least one target device of at least one vehicle, comprising:

(a) connecting at least one portable computer device to at least one network;

(b) transmitting a session request to the at least one target device;

(c) receiving an acknowledgement from the at least one target device if the session request is accepted by the at least one target device;

(d) at least one of: (i) directly or indirectly receiving at least a portion of data input to or output from the at least one target device, and (ii) directly or indirectly transmitting data to the at least one target device;

(e) displaying at least a portion of at least one of: (i) the data input to or output from the at least one target device and (ii) the transmitted data, on at least one interface on the at least one portable computer device;

(f) directly or indirectly receiving revision data associated with software or firmware of the at least one target device from at least one of the network and a back office server;

(g) transmitting at least a portion of the revision data directly or indirectly to the at least one target device; and (h) causing at least a portion of the software or firmware to be modified based at least in part upon at least a portion of the revision data, wherein connecting the at least one portable computer device to the at least one network comprises connecting first to a general vehicle network and second to a target device vehicle network.

32. A data management method for at least one target device of at least one vehicle, comprising:

(a) connecting at least one portable computer device to at least one network;

(b) directly or indirectly receiving revision data associated with software or firmware of the at least one target device from at least one of the network and the back office server;

(c) transmitting at least a portion of the revision data directly or indirectly to the at least one target device; and (d) causing at least a portion of the software or firmware to be modified based at least in part upon at least a portion of the revision data, wherein connecting the at least one portable computer device to the at least one network comprises connecting first to a general vehicle network and second to a target device vehicle network.

33. A system for remotely verifying the installation and operation of an event recorder without performing an event recorder data download, comprising:

a portable computer device configured to:

remotely connect to an event recorder, the event recorder being installed on a vehicle and periodically or continuously receiving data from at least one target device via at least one data channel;

send a stream subscription message to the event recorder, wherein the stream subscription message causes the event recorder to stream the contents of the at least one data channel to the portable computer device;

determine, based on the contents of the at least one data channel, a health of the event recorder, wherein the determined health of the event recorder comprises a determination of whether the at least one event recorder is functioning in accordance with a predetermined format; and generate an indication of the determined health of the event recorder.

34. The system of claim 33, wherein the portable computer device is further configured to terminate the stream subscription message once the health of the event recorder has been determined.

35. The system of claim 33, wherein at least a portion of the event recorder is contained within a crash-resistant housing configured to protect the data stored thereon in the event of a crash.

36. The system of claim 33, wherein the portable computer is further configured to:

connect to a general vehicle network;

directly or indirectly receive revision data associated with software or firmware of the event recorder;

transmit at least a portion of the revision data directly or indirectly to the event recorder; and cause at least a portion of the software or firmware to be modified based at least in part upon at least a portion of the revision data.

37. The system of claim 36, wherein the portable computer device is configured or programmed to connect first to the general vehicle network and second to the event recorder.

* * * * *